United States Patent [19]

Chuan-Shiang

[11] Patent Number: 5,070,675

[45] Date of Patent: Dec. 10, 1991

[54] INFLATING AND HEAT SEALING APPARATUS FOR PLASTIC PACKING BAGS

[75] Inventor: Chiang Chuan-Shiang, Taipei Hsien, Taiwan

[73] Assignee: Jen-Wei Lin, Taipai, Taiwan

[21] Appl. No.: 662,641

[22] Filed: Mar. 1, 1991

Related U.S. Application Data

[63] Continuation-in-part of Ser. No. 471,448, Jan. 29, 1990, abandoned.

[51] Int. Cl.[5] ..... B65B 31/06

[52] U.S. Cl. ..... 53/79; 53/512

[58] Field of Search ..... 53/79, 403, 434, 432, 53/512, 510, 474, 473, 284.7, 390

[56] References Cited

U.S. PATENT DOCUMENTS

| | | | |
|---|---|---|---|
| 2,800,756 | 7/1957 | Schild | 53/512 X |
| 2,963,838 | 12/1960 | Harrison et al. | 53/512 X |
| 4,136,502 | 1/1979 | Shore | 53/79 X |
| 4,330,975 | 5/1982 | Kakiuchi | 53/512 X |
| 4,597,244 | 7/1986 | Pharo | 53/512 X |
| 4,926,614 | 5/1990 | Costello et al. | 53/512 X |
| 4,970,844 | 11/1990 | Domenichiello | 53/512 X |

*Primary Examiner*—James F. Coan

*Attorney, Agent, or Firm*—Lowe, Price, LeBlanc & Becker

[57] ABSTRACT

Disclosed is an apparatus for inflating and heat sealing plastic packing bags. The apparatus includes inflating means, heat sealing means, and automatic control means. The configuration of the apparatus is arranged in order to facilitate the procedures in automation. That is, after manually attaching a packing bag to the nozzle of the apparatus, the subsequent procedures of inflating and heat sealing are all automatically performed by the apparatus.

6 Claims, 5 Drawing Sheets

INFLATING AND HEAT SEALING APPARATUS FOR PLASTIC PACKING BAGS

CROSS REFERENCE

This is a continuation-in-part of U.S. patent application Ser. No. 07/471,448, filed Jan. 29, 1990, now abandoned.

The inventor is aware of the following pertinent patents:

U.S. Pat. No. 4,136,502 to Shore.
U.S. Pat. No. 2,963,838 to Harrison and Welch.
U.S. Pat. No. 4,597,244 to Pharo.
U.S. Pat. No. 4,330,975 to Kakiuchi.
U.S. Pat. No. 2,800,756 to Schild.

BACKGROUND OF THE INVENTION

The present invention relates generally to an apparatus adapted to inflate and heat seal plastic packing bags used for receiving fragile articles such as flower and the like.

Despite the fact that substantial need has been directed to flower products in international markets, difficulties in packing, accumulating, transporting and storing such fragile articles have limited the quantity of this kind of products in international trade. Nevertheless, not even one simple protection technique for such fragile articles has been successfully developed so far.

SUMMARY OF THE INVENTION

It is therefore a primary object of the present invention to provide an apparatus which is capable of inflating and heat sealing a plastic packing bags for fragile articles.

In accordance with the present invention, an inflating and heat sealing apparatus for plastic packing bags comprises: a blower adapted to inflate plastic packing bags; a main shaft; a motor for driving the blower and the main shaft; a clutch for connecting or disconnecting the power transfer between the motor and the main shaft; heating means for clamping and heat sealing the entrance portion of the bag; a first gas passage for introducing a first gas into the blower; a first solenoid valve, which is installed in the first gas passage, for allowing or stopping the gas flow therein; a solenoid-controlled member, adapted to control the clutch; a first microswitch, which is adapted to actuate the first solenoid valve to stop the first gas from entering the blower, and to actuate the solenoid-controlled member to connect the clutch; a set of first cams, fixed to the main shaft, for driving the heating means upward to clamp the entrance portion of the bag; a second cam which is also fixed to the main shaft; a second microswitch, which is actuated by the second cam when the entrance portion of the bag is clamped, for initiating the heating means to heat seal the bag; and a third microswitch which is actuated by the second cam when the heat sealing process has been completed for turning off the power supply for the motor.

The advantages and benefits of the foregoing apparatus can be best understood by a reading of the following detailed description of a preferred embodiment according to the present invention, taken in conjunction with the accompanying drawings.

DETAILED DESCRIPTION OF THE PREFERRED EMBODIMENTS

Figure 1:
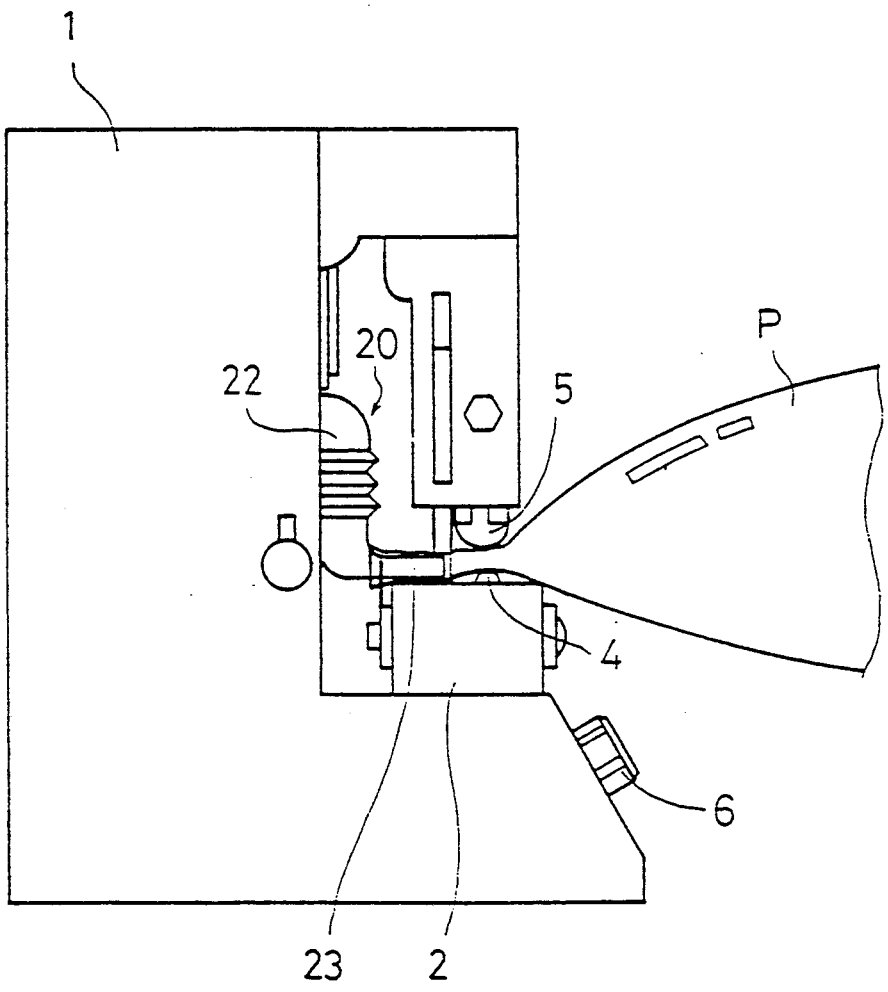
FIG. 1 is a side view showing the appearance of the whole inflating and heat sealing apparatus of the present invention which is shown in a state of performing inflating operation of a packing bag.
Figure 2:
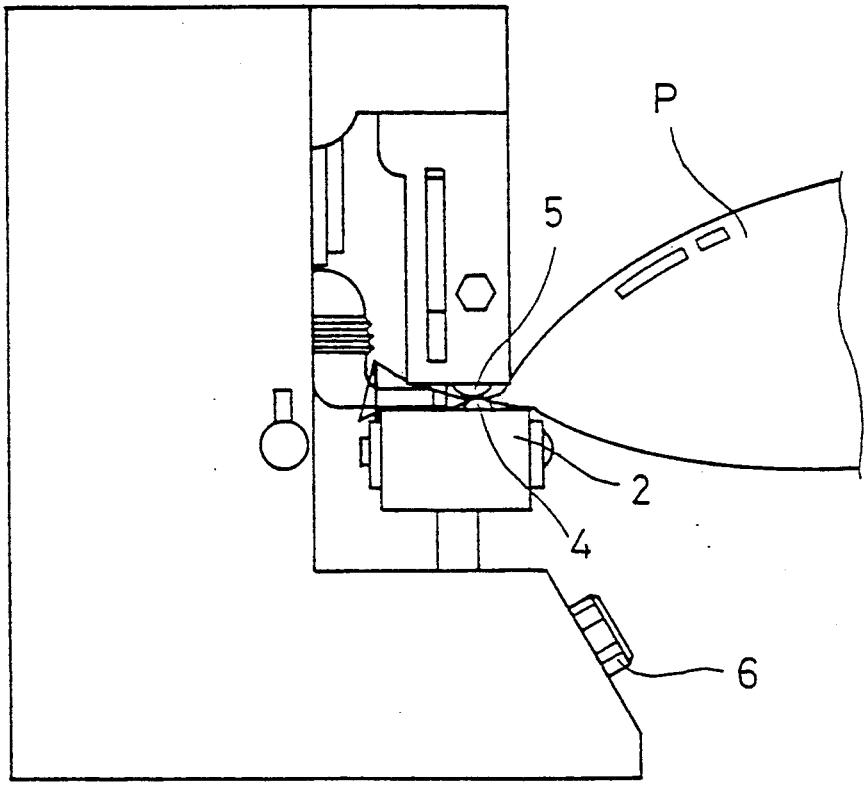
FIG. 2 is a view similar to FIG. 1 except that the same apparatus is in a state of performing heat sealing operation of a packing bag.

Now please refer to FIGS. 1-2 first, both of these two figures show the appearance of the whole inflating and heat sealing apparatus of the present invention. Whereas FIG. 1 shows the apparatus being inflating the packing bag P, and FIG. 2 shows the apparatus being heat sealing the packing bag P.

As shown in FIGS. 1-2, the part of the inflating and heat sealing apparatus of the present invention which can be seen from the appearance comprises a frame 1; a vertically movable work table 2; a heating means 4 fitted on the work table 2 for heat sealing a packing bag P; a clamping member 5, which is fitted opposite to the heating means 4 and cooperates with the heating means 4 to clamp and heat seal the entrance portion of the packing bag P; a power switch 6; and a part of a blower 20 including a duct 22 and an inflating nozzle 23. In FIG. 1, the work table 2 stays at a lower position, and a proper space is provided between the heating member 4 and the clamping member 5 for attaching the packing bag P to the inflating nozzle 23. In FIG. 2, the work table 2 has been raised to an upper position, and is firmly urged against the clamping member 5 with the entrance portion of the packing bag P being clamped therebetween for heat sealing.

Figure 3:
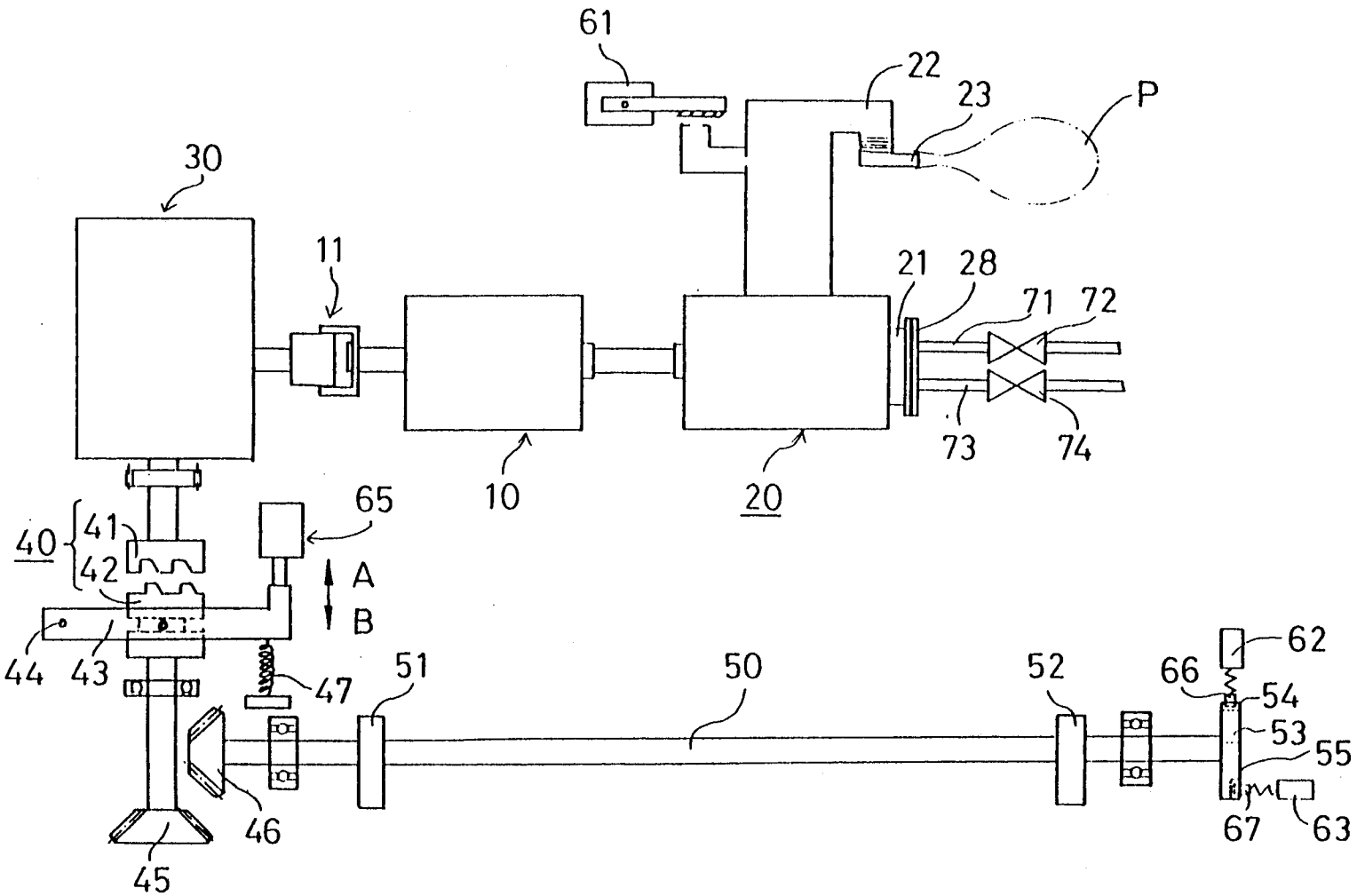
FIG. 3 is a schematic plan view showing the characteristic part in the apparatus according to a preferred embodiment of the present invention.

FIG. 3 shows the characteristic part in the apparatus according to preferred embodiment of the present invention, which comprises: a blower 20 having an inlet port 21, for introducing gas thereinto; a first gas passage (duct) 71, connected to the inlet port 21 of the blower 20, through which a first gas (such as air) can be introduced into the blower 20; a first solenoid valve 72, which is installed in the first gas passage 71, and is capable of allowing or stopping the gas flow in the first gas passage 71 into the blower 20; a second gas passage (duct) 73 which is connected, in parallel with the first gas passage 71, to the inlet port 21 of the blower 20 for introducing a second gas (such as carbon dioxide, nitrogen or oxygen) into the blower 20; a second solenoid valve 74 which is installed in the second gas passage 73, and is capable of allowing or stopping the gas flow therein into the blower 20; a main shaft 50; a motor 10 adapted to drive the blower 20 and to transfer power to the main shaft 50; a speed reducer 30 interconnecting the output shaft of the motor 10 and the input end of the main shaft 50 for reducing the high rotating speed of the motor 10 to a lower rotating speed, and driving the main shaft 50 at this lower speed; a clutch 40 interposed between the speed reducer 30 and the main shaft 50, for connecting or disconnecting the power transfer from the motor 10 to the main shaft 50; a solenoid controlled member 65 for controlling the clutch 40 through a push arm 43; a flexible coupling 11 interposed between the motor 10 and the speed reducer 30; a pair of bevel gears 45, 46 for transferring the rotating power from the clutch 40 to the main shaft 50; a first microswitch 61 which, upon detecting the completion of inflating operation, is adapted to actuate the first solenoid valve 72 or the second solenoid valve 74 to stop the first or the second gas from entering the blower 20, and to actuate the solenoid-controlled member 65 to connect the clutch 40 for allowing power transfer from the motor 10 through the speed reducer 30 to the main shaft 50; a pair of first cams 51, 52 are fixed on the main shaft 50 and rotate therewith for driving the work table 2 and heating means 4 upward (FIG. 2) in order to clamp and heat seal the entrance portion of the packing bag P; a second cam 53 which is also fixed on the main shaft 50 and rotates therewith; a second microswitch 62 actuated by the second cam 53 when the entrance portion of the bag P is clamped for initiating the heating means 4 to heat seal the bag P; a timer (not shown) for controlling the heating time duration; a third microswitch 63 actuated by the second cam 53 when the heat sealing operation has been completed for turning off the power supply for the motor 10. While not shown in FIG. 3, there is provided a selective controlling means which can be optionally switched to control either the first solenoid valve 72 or the second solenoid valve 74 for selectively allowing the introduction of either the first gas or the second gas into the blower 20.

Figure 4:
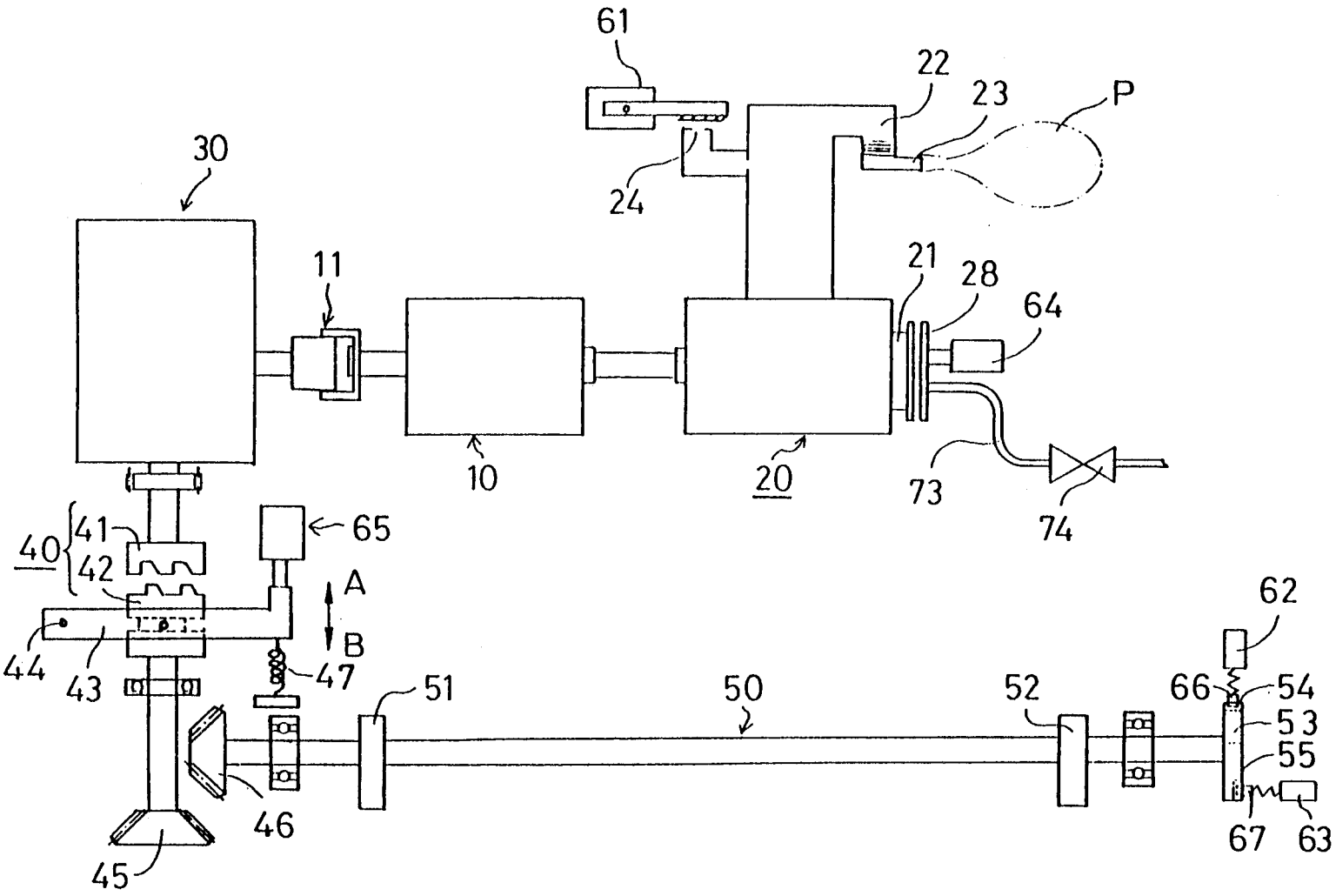
FIG. 4 is a view similar to FIG. 3 except that the construction of the solenoid valve for controlling the intake of gas is slightly different.

Next, please refer to FIG. 4, this figure is similar to FIG. 3 except a slight change of form of the solenoid valve 72 which controls the introduction of first gas (air) into the blower 20. In this case, since the first gas to be inflated into the packing bag P is air filling the environment, the first gas (air) passage may takes the form shown in FIG. 4, instead of the pipe 71 as shown in FIG. 3. Also, the first solenoid valve 72 may be replaced by an electromagnetic movable member 64 and a closing member 28 attached to the electromagnetic movable member 64. The electromagnetic movable member 64 can be actuated by the first microswitch 61 to open or close the inlet port of the blower 20 in cooperation with the closing member 28.

Figure 5:
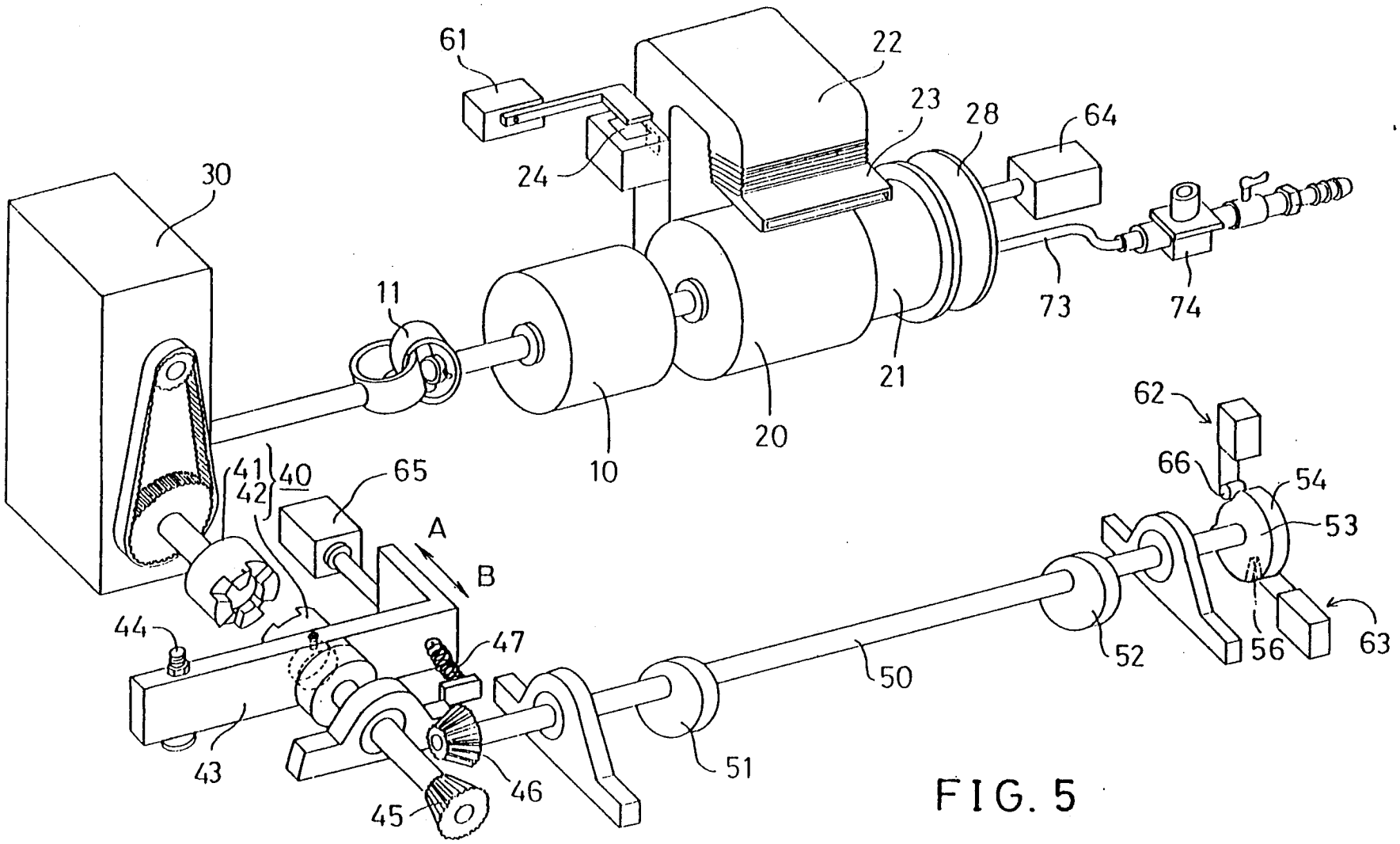
FIG. 5 is a perspective view of the arrangement shown in FIG. 4.

Now, the construction of the blower 20, clutch 40, and the second cam 53 will be described in further detail by referring to FIGS. 4 and 5.

In the blower 20, a bypass outlet port 24 is provided in parallel with the inflating nozzle 23, so that the completion of inflating operation may be detected by the first microswitch 61 by sensing the pressure change of gas flowing out from the bypass outlet 24 when the inflating operation is finished.

The clutch 40 comprises a fixed portion 41 connected to the speed reducer 30; and a movable portion 42 connected to the bevel gear 45. The electromagnetic movable member 65, being actuated by the first microswitch 61, will drive the push arm 43 rotate around the pivot 44 in the A direction, and thus connect the movable portion 42 to the fixed portion 41 of the clutch 40. On the other hand, when the electromagnetic movable member 65 is not actuated by the first microswitch 61, a restoring spring 47 will pull back the push arm 43 in the B direction, and thus disconnect the movable portion 42 from the fixed portion 41 of the clutch 40.

The second cam 53 gas two operating cam surfaces including a peripheral surface 54 and a side surface 55 (shown only in FIG. 4) for actuating the second microswitch 62 and the third microswitch 63 respectively. The second microswitch 62 has a first detecting member 66 which, when contacting a protrusion on the peripheral surface 54, sends a command to the heating means 4 to initiate the heat sealing operation. The third microswitch 63 has a detecting member 67 (shown only in FIG. 4) which, when contacting a recess 56 on the side surface 55, sends a command to turn off the power supply for the motor 10. Thus, a cycle is completed and a new packing bag can be replaced to the nozzle 23 to begin another cycle.

As a conclusion, the operation of this apparatus comprises the following simple steps:

(a) fixing the entrance portion of the packing bag P to the nozzle 21 of the blower 20;

(b) connecting the gas passage 71 or 73 to a gas container and setting the selective control means for the proper option;

(c) turning on the power supply for the motor 10.

And everything goes automatically after step (c), namely the inflating operation, the heat sealing operation and the termination of a working cycle. The automation comprises the following steps:

(1) The blower 20 begins to inflate the packing bag P;

(2) The first microswitch 61, upon detecting the completion of the inflating operation, sends two commands, one to the solenoid valve 71 to stop the entrance of the gas, and the other one to the clutch 40 to allow the power transfer from the motor 10 to the main shaft 50;

(3) The cams 51, 52 rotate with the main shaft 50, and thus drive the heating means 4 upward to clamp the entrance portion of the packing bag P; and (4) The cam 53 actuates the second microswitch 62 to begin the heat sealing operation by the heating means 4, and then actuates the third microswitch 63 to turn off the power supply of the motor 10, and thus completes one cycle of inflating and heat sealing operation.

While the invention has been described by way of example and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An apparatus for inflating and heat sealing plastic packing bags, comprising:

a blower adapted to inflate plastic packing bags, having an inlet port for inhaling gases thereinto;

a main shaft;

a motor for driving said blower and said main shaft;

a clutch interposed between said motor and said main shaft for connecting or disconnecting the power transfer between said motor and said main shaft;

heating means for clamping and heat sealing the entrance portion of the bag after the completion of the inflating operation;

a first gas passage connecting to said inlet port in said blower for introducing a first gas into said blower;

a first solenoid valve which is installed in said first gas passage and can be controlled to allow or stop the gas flow therein;

a solenoid-controlled member adapted to control said clutch for connecting or disconnecting the power transfer between said motor and said main shaft;

a first microswitch which upon detecting the completion of inflating operation, is adapted to actuate said first solenoid valve to stop the first gas from entering said blower and to actuate said solenoid-controlled member to connect said clutch for allowing power transfer from said motor to said main shaft;

a set of first cams, fixed to said main shaft, for driving said heating means upward to clamp the entrance portion of the bag after finishing the inflating operation;

a second cam fixed to said main shaft;

a second microswitch which is actuated by said second cam when the entrance portion of the bag is clamped for initiating said heating means to heat seal the bag; and a third microswitch which is actuated by said second cam when the heat sealing process has been completed for turn off the power supply for said motor.

2. An apparatus for inflating and heat sealing plastic packing bags as claimed in claim 1, further comprising:

a second gas passage connected, in parallel with said first gas passage, to said inlet port of said blower for introducing a second gas into said blower;

a second solenoid valve which is installed in said second gas passage and can be controlled to allow or stop the gas flow therein;

selective controlling means which can be optionally switched to control either said first solenoid valve or said second solenoid valve for selectively allowing the introduction of either the first gas or the second gas into said blower.

3. An apparatus for inflating and heat sealing plastic packing bags as claimed in claim 1, wherein said first gas is air, and said first solenoid valve comprises an electromagnetic movable member and a closing member attached to said electromagnetic movable member, and wherein said electromagnetic movable member may be actuated by said first microswitch to open or close said inlet port of said blower in cooperation with said closing member.

4. An apparatus for inflating and heat sealing plastic packing bags as claimed in claim 1, further comprising a speed reducer interconnecting said motor and said clutch.

5. An apparatus for inflating and heat sealing plastic packing bags as claimed in claim 4, wherein said blower further comprising a bypass outlet port provided in parallel with the inflating nozzle of said blower, so that the completion of inflating operation may be detected by said first microswitch by sensing the pressure change of gas flowing out from said bypass outlet.

6. An apparatus for inflating and heat sealing plastic packing bags as claimed in claim 5, further comprising a flexible coupling interconnecting said motor and said speed reducer.

* * * * *